United States Patent [19]

Yamaguchi et al.

[11] Patent Number: 4,737,086

[45] Date of Patent: Apr. 12, 1988

[54] FUEL INJECTION PUMP HAVING VARIABLE PRESTROKE MECHANISM

[75] Inventors: Susumu Yamaguchi; Hiroshi Ishiwata; Noriyuki Abe; Hiroshi Tai; Hisashi Nakamura, all of Higashi-Matsuyama, Japan

[73] Assignee: Diesel Kiki Co., Ltd., Tokyo, Japan

[21] Appl. No.: 862,485

[22] Filed: May 12, 1986

[51] Int. Cl.[4] ..... F04B 7/04; F02M 37/04; F02M 59/20

[52] U.S. Cl. ..... 417/499; 123/500; 123/503

[58] Field of Search ..... 417/494, 499; 123/500, 123/501, 502, 449

[56] References Cited

U.S. PATENT DOCUMENTS

| | | | |
|---|---|---|---|
| 1,819,015 | 8/1931 | Benes | 417/494 |
| 2,731,917 | 1/1956 | Evans | 417/494 |
| 3,138,103 | 6/1964 | Dreisin | 417/494 |
| 3,371,610 | 3/1968 | DeLuca | 417/494 |
| 4,649,883 | 3/1987 | Bohringer | 123/503 |

FOREIGN PATENT DOCUMENTS

| | | | |
|---|---|---|---|
| 105616 | 8/1979 | Japan | 123/503 |
| 1395384 | 5/1975 | United Kingdom | 123/503 |
| 2142986 | 1/1985 | United Kingdom | 123/503 |
| 918486 | 4/1982 | U.S.S.R. | 123/503 |

*Primary Examiner*—Carlton R. Croyle
*Assistant Examiner*—Jane E. Obee
*Attorney, Agent, or Firm*—Wenderoth, Lind & Ponack

[57] ABSTRACT

A fuel injection pump includes a reciprocating plunger and a control sleeve slidably fitted over the plunger, the prestroke of which is varied by vertical movement of the control sleeve. The control sleeve is provided at its upper end with a fuel discharge groove, through which the fuel contained in a fuel-pressurizing chamber is discharged after the end of injection. The control sleeve also has to pressure escape passage. A variation in the effective stroke allows the pressure of fuel contained in the fuel-pressurizing chamber to be selectively regulated by the pressure escape passage, thereby controlling the pressure of fuel to be injected.

8 Claims, 6 Drawing Sheets

FUEL INJECTION PUMP HAVING VARIABLE PRESTROKE MECHANISM

BACKGROUND OF THE INVENTION

1. Field of the Invention

The present invention relates generally to a fuel injection pump and, more particularly, to a fuel injection pump having a variable prestroke mechanism.

2. Description of the Related Art

Fuel injection pumps having a variable prestroke mechanism are known from Japanese Utility Model Kokai-Publication No. 58(1983)-114875, for example. The fuel injection pump of that example is illustrated in FIGS. 16 to 18.

Referring to FIGS. 16 to 18, a pump body 1 is fixedly provided with a plunger barrel 3 into which a plunger 4 is slidably inserted. That plunger 4 is designed to reciprocate upon receiving input from an engine. A portion of the plunger 4 facing a fuel reservoir chamber 18 is provided with a hole 24 through which an amount of fuel is sucked or discharged, and a control inclined groove 26. A control sleeve 17 is slidably fitted thereover and has a cut-off hole 28 extending therein in the radial direction. A control rod 29 is provided at right angles to the control sleeve 17. An engaging portion 36 extending radially from the control rod 29 is in engagement within an associated groove 22 formed in the control sleeve 17. Thus, turning of the control rod 29 causes turning of the engaging portion 36 in unison therewith. Turning of the portion 36 then causes vertical movement of the control sleeve 17, so that there is a variation in the vertical position of the plunger 4 relative to the control sleeve 17. This makes it possible to control the prestroke of plunger 4 which is the distance between the control sleeve 17 and the aforesaid hole 24.

When supplying fuel, the plunger 4 ascends to cause the hole 24 to be closed by the control rod 17 for the initiation of fuel injection (pumping of fuel), as illustrated in FIG. 16, while the injection of fuel ceases upon the control inclined groove 26 in communication with the hole 24 coming in communication with the cut-off hole 28 in the control sleeve 17, as shown in FIG. 17.

In some cases, however, as the plunger 4 continues to move upwardly even after the pumping of fuel has been finished, the control inclined groove 26 passes beyond the cut-off hole 28 and is closed by the control sleeve 17, as illustrated in FIG. 18. In this case, the upper portion of the groove 26 projects upwardly from the control sleeve 17, and communicates with the fuel reservoir chamber 18. However, especially when the prestroke is increased and the control sleeve 17 is close to a lower face 5*a* of a valve housing 5, an escape passage for high-pressure is very narrow so that the discharge of return fuel is restricted which causes a secondary injection of fuel due to a temporary increase in the pressure prevailing in an injection pipe.

Control of the prestroke, as mentioned above, leads to a variation in the range in which a cam is used to reciprocate the plunger 4. Thus, where a non-uniform speed cam is used, the rate of fuel injection relative to the speed of plunger 4 varies. As the rate of injection increases, the pressure of injection increases, so that, when the number of revolutions of an engine is increased, there is a possibility that the pressure of injection will exceed the allowable pressure provided for a fuel-pressurizing chamber or the injection pipe. A solution to this anticipated problem may be achieved by increasing the strength of the fuel injection pump. However, this results in an increase in the weight of the pump.

SUMMARY OF THE INVENTION

An object of the present invention is to eliminate the problems which are explained above in connection with the prior art fuel injection pumps.

Another object of the present invention is to prevent the occurrence of secondary injection by smooth discharging of return fuel after cutting-off regardless of where the control sleeve is positioned in the fuel injection pump.

A further object of the present invention is to keep the pressure of injection low at a high speed.

A still further object of the present invention is to achieve the aforesaid smooth discharging of fuel by improving the structure of the control sleeve.

A still further object of the present invention is to achieve control of the pressure of injection by improving the structure of the control sleeve.

According to one aspect of the present invention, there is provided a fuel injection pump with a variable prestroke mechanism comprising a reciprocating plunger, a control sleeve slidably fitted over the plunger and means for varying the axial position of said plunger relative to said control sleeve which is formed with a fuel discharge groove at the upper end thereof. After cutting-off, an amount of fuel is returned through the fuel discharge groove.

According to another aspect of the present invention, there is provided a fuel injection pump comprising a reciprocating plunger, a control sleeve slidably fitted over the plunger, means for varying the axial position of said plunger relative to said control sleeve and means for varying the radial position of said plunger relative to said control sleeve wherein said control sleeve is provided with a connection port formed on the inner face thereof over which said plunger slides and with means connected to said connection port to vent the pressure of fuel prior to the end of injection of said plunger, when the effective stroke of said plunger is adjusted to a value higher than the predetermined value by said means for varying the radial position of said plunger relative to said control sleeve. Therefore, it is possible to restrict the fuel pressure when operating in high speed, because fuel can escape via said escaping means.

Many other advantages, features and additional objects of the present invention will become manifest to those versed in the art upon making reference to the detailed description and the accompanying sheets of drawings on which preferred structural embodiments incorporating the principles of the invention are shown by way of illustrative examples.

DETAILED DESCRIPTION OF THE PREFERRED EMBODIMENTS

Figure 1:
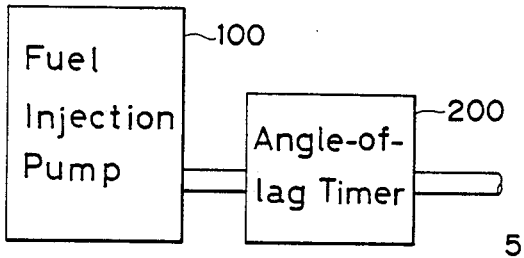
FIG. 1 is a block diagram of a fuel injection apparatus.

Referring to FIG. 1, a fuel injection pump having a variable prestroke mechanism is generally shown at 100, and is joined to an output shaft of an engine via an angle-of-lag timer 200. The pump 100 is designed in such a manner that an angle of lag occurs at the number of revolutions higher than that of a driving shaft of the pump 100, at which the pressure of fuel supplied therefrom exceeds the allowable level.

Figure 2:
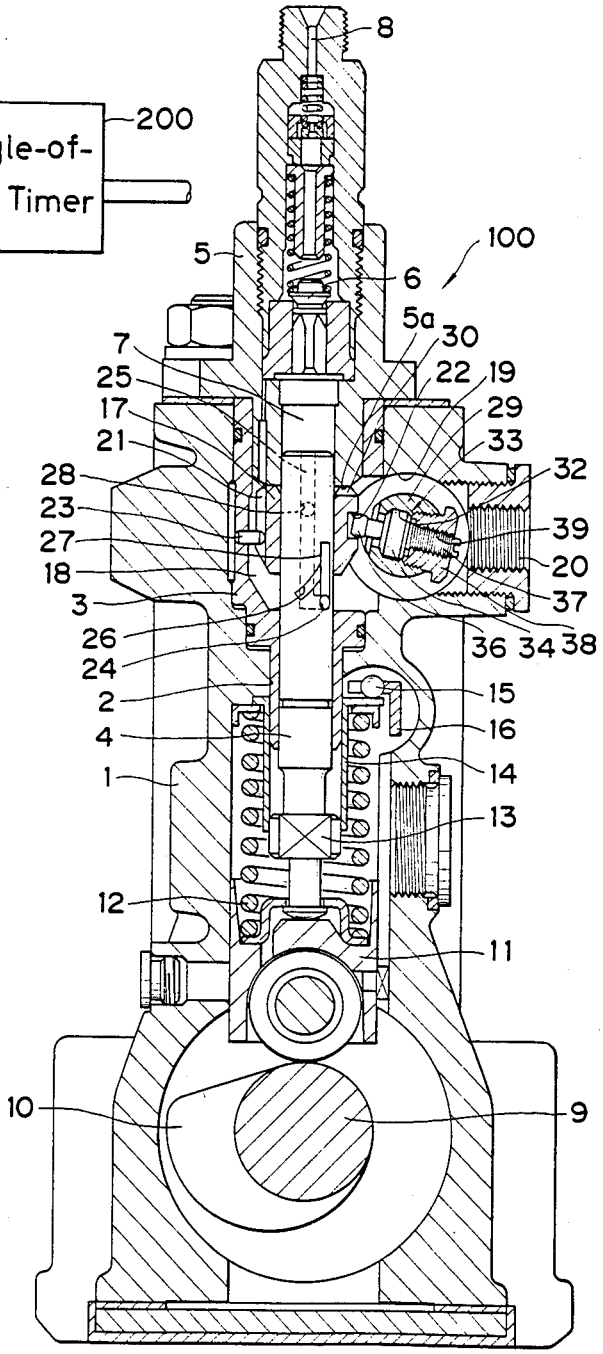
FIG. 2 is a sectional view of a first embodiment of the fuel injection pump according to the present invention.

The fuel injection pump 100 is of the line type, as illustrated in FIG. 2, and includes a pump body 2 having a longitudinal bore 2 extending therethrough. Within the bore 2, a plunger barrel 3 is fixed to the body 1. A plunger 4 is slidably inserted into the barrel 3, and is inserted at the upper end into a valve housing 5 fixedly provided on the body 1. Within the valve housing 5, there is a delivery valve 6. A fuel-pressurizing chamber 7 is defined between the plunger 4 and the delivery valve 6. Above the delivery valve 6, the body 1 is provided with a fuel outlet 8.

Figure 6:
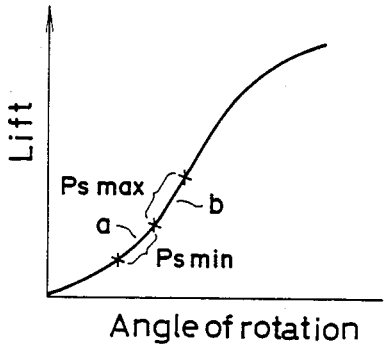
FIG. 6 is a cam diagram of a cam used in the foregoing fuel injection pump.

The plunger 4 abuts, at the lower end thereof, against a cam 10 formed on a cam shaft 9 through a tappet 11. The cam shaft 9 is joined to an output shaft of an engine through the angle-of-lag timer 200. For instance, the cam 10 may be a tangential cam, and has cam characteristics as illustrated in FIG. 6. Since the tappet 11 is pressed against the cam 10 by a spring 12, the plunger 4 reciprocates at non-uniform speeds along the contour curve of cam 10, as the cam shaft 9 receives the driving force of the engine and rotates at an equal speed.

The plunger 4 is provided with a face portion 13, which in turn engages a rotatable sleeve 14 fitted over the plunger barrel 3. The sleeve 14 is fixedly provided on a flange portion with an engaging protrusion 15, with which a rod 16 for regulating the amount of fuel to be injected is engaged. The plunger 4 rotates in response to the movement of said rod 16 to vary the relative position of plunger 4 and a control sleeve 17 (to be described later) in the circumferential direction.

The plunger 4 is formed with a hole 24 through which fuel is sucked and discharged in a radial direction. The hole 24 is open at one end in a fuel reservoir chamber 18 defined by the plunger barrel 3 and the valve housing 5. The plunger 4 is also provided with a communication hole 25 extending in the axial direction, which is connected at one end to the hole 24 and at the other end to the fuel-pressurizing chamber 7. In addition, the plunger 4 is provided on the outer surface with a control inclined groove 26 and a longitudinal groove 27, the groove 27 communicating with hole 24. The fuel reservoir chamber 18 is connected to an fuel inlet 20 through a lateral hole 19 formed in the body 1.

Figure 3:
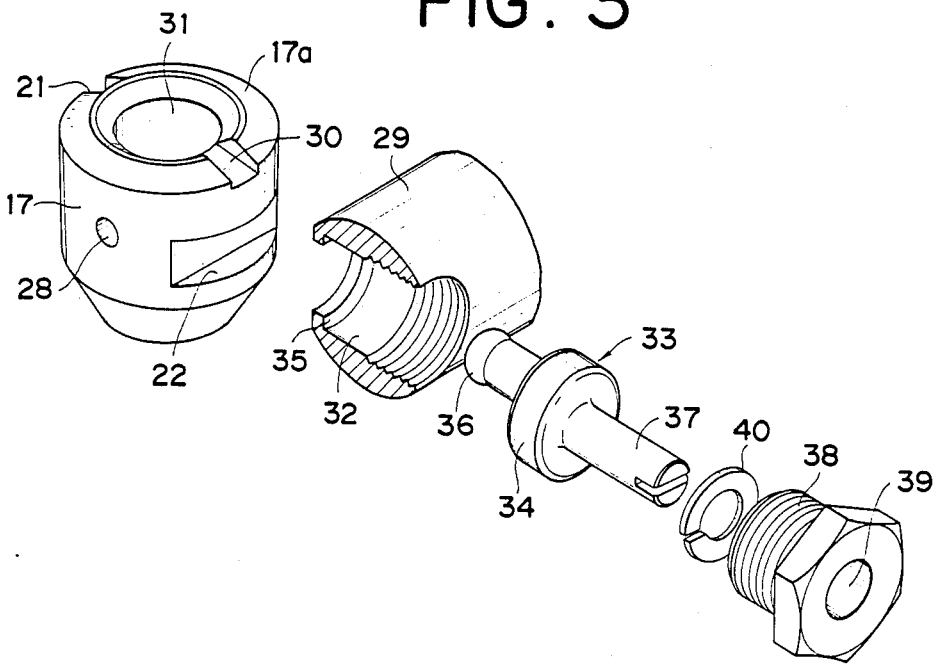
FIG. 3 is an exploded perspective view illustrating the structure of a control sleeve coupled to a control rod, both used in the foregoing fuel injection pump.
Figure 4:
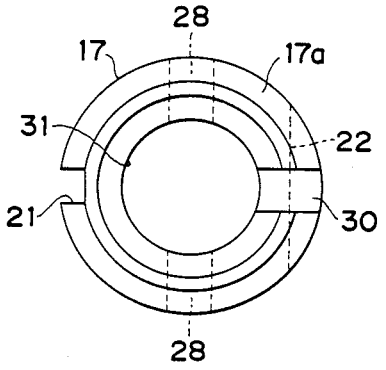
FIG. 4 is a plan view of the foregoing control sleeve.
Figure 5:
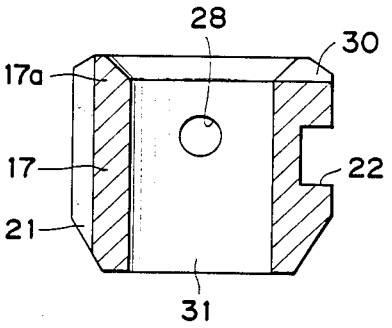
FIG. 5 is a sectional view of the foregoing control sleeve.

The control sleeve 17 is disposed within the fuel reservoir chamber 18, and is slidably fitted over the plunger 4. As illustrated in FIGS. 3 to 5, the control sleeve 17 is formed with a guide groove 21 in the rear portion thereof and an engaging groove 22 in the front portion thereof. A guide pin 23 provided on the plunger barrel 3 engages within the guide groove 21, while an engaging portion 36 of a control rod 29 (to be described later) engages within the engaging groove 22. Furthermore, the control sleeve 17 is provided in the substantial intermediate portion thereof with a radial cut-off hole 28, which in turn communicates with an inside hole 31 extending in the control sleeve 17 in the centrally axial direction.

The control sleeve 17 includes an upper end portion 17*a* having a trapezoidal shaped cross-section, in which a fuel discharge groove 30 extends in the radial direction. The fuel discharge groove 30 is to keep the inside hole 31 in the sleeve 17 and the fuel chamber 18 in communication with each other even when the sleeve 17 moves upwardly to a maximum to obtain the maximum prestroke and abuts against the lower face 5*a* of the valve housing 5.

The control rod 29 is inserted in the lateral hole 19 in the pump body 1, and is rotatably supported thereon through a bearing, not shown. Furthermore, the control rod 29 has one end connected to an actuator of a step motor (not illustrated) etc. for rotation. As also illustrated in FIG. 3, the control rod 29 is provided with a window portion 32 in opposition to the control sleeve 17, said window portion extending through said control rod 29 in the diametrical direction. An engaging shaft 33 is inserted into the window portion 32, and includes a disk-like body member 34 which is rotatably fitted on a stepped portion 35 formed on said window portion 32. The shaft 33 includes an engaging portion 36 integral with the disk-like body member 34, which is eccentric with respect to the body 34, and extends from the window portion 32 into engagement within the engaging groove 22 in the control sleeve 17. On the side of the shaft 33 opposite to the engaging portion 36, there is a regulation rod portion 37 integral with the body 34, which passes through a central hole 39 formed in a cap screw 38. The cap screw 38 is threaded in the window portion 32 to keep the body 34 of the engaging shaft 33 in place through a washer 40.

Referring to the operation of the fuel injection pump 100 per se, at the outset during which the plunger 4 ascends from the bottom dead point, there is no increase in the pressure of fuel present in the fuel-pressurizing chamber 7, so that the delivery valve 6 remains closed. This is because the hole 24 through which fuel is sucked and discharged is open in the fuel reservoir chamber 18, so that the chamber 7 is in communication with the chamber 18 via the hole 24 and the communication hole 25. As the plunger 4 ascends further from such a state to a state at which the hole 24 is positioned above the lower face of the control sleeve 17, the hole 24 is closed by the control sleeve 17, whereby the pressure of fuel in the chamber 7 increases to deliver an amount of fuel through the fuel outlet 8. Thus, the prestroke of plunger 4 is defined by a distance from the bottom dead point of plunger 4 to the point at which the hole 24 is closed, and the start of injection is defined as the time at which the hole 24 is closed. The further ascent of plunger 4 causes the control inclined groove 26 to communicate with the cut-off hole 28 in the control sleeve 17, and communication is established between the chambers 7 and 18 through a fuel passage means comprising the communication hole 25, hole 24 through which fuel is sucked and discharged, control inclined groove 26 and cut-off hole 28, thereby resulting in a decrease in the pressure of fuel present in the fuel-pressurizing chamber 7 and the closing of the delivery valve 6 during the completion of fuel delivery. This time represents the end of fuel injection, and the effective stroke of plunger 4 is defined by the displacement of the plunger from the start to the end of injection.

Still further ascent of plunger 4 causes the control inclined groove 26 to pass beyond the cut-off hole 28, and to be closed again by the control sleeve 17. However, the upper portions of the groove 26 and the longitudinal hole 27 project from the upper portion of the control sleeve 17, and communicate with the fuel reservoir chamber 18 through the fuel discharge groove 30. Thus, even though the prestroke reaches a maximum and the control sleeve 17 is close to, or abuts against, the lower face 5a of the valve housing 5, an amount of return fuel can flow back into the fuel reservoir chamber 18 from the fuel discharge groove 30 without any resistance.

The aforesaid effective stroke can be adjusted by the rotation of plunger 4 with the rod 16 for regulating the amount of fuel to be injected, while the aforesaid prestroke can be adjusted by the vertically movement of the control sleeve 17 with the control rod 29.

The operation of the entire system including the angle-of-lag timer 200 will now be explained.

Figure 7:
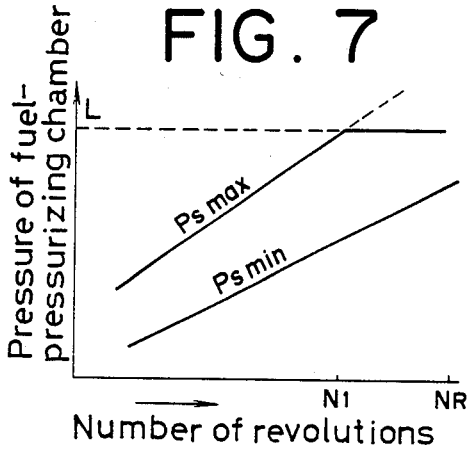
FIG. 7 is a diagram showing changes in the pressure of a fuel-pressurizing chamber relative to the number of revolutions.

More specifically, lift by the cam surface of cam 10 with respect to the angle of rotation is illustrated in FIG. 6. When the prestroke is small, lift is represented by a gentle slope portion of the cam diagram, as shown in FIG. 6 by a region a. On the other hand, when the prestroke is large, lift is represented by a sharp slope portion of the cam diagram, as shown in FIG. 6 by a region b. Consequently, the pressure prevailing in the fuel-pressurizing chamber 7 with respect to the number of revolutions of the cam shaft 9 varies depending upon the amount of prestroke, as illustrated in FIG. 7. The greater the prestroke, the more the pressure will be. When the amount of prestroke assumes a maximum value Psmax, the pressure prevailing in the chamber 7 exceeds an allowable pressure L and $N_1$ r.p.m. It is to be noted that, in FIG. 7, $N_R$ stands for the rating number of revolutions, and Psmin shows a minimum value of the prestroke.

Figure 8:
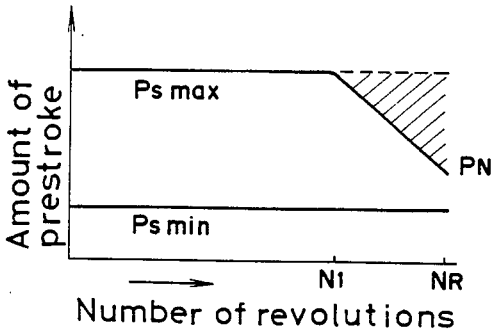
FIG. 8 is a diagram showing the prestroke relative to the number of revolutions.

Exceeding the allowable pressure L in the fuel-pressurizing chamber 7 is dangerous. To prevent this, the prestroke is reduced so that it is within a range which ensures that the allowable pressure L prevails in the chamber 7. In this case, the prestroke Ps with respect to the N r.p.m. of the cam shaft 9 is illustrated in FIG. 8. In FIG. 8, the hatched region shows an unavailable range due to the limitation of the allowable pressure L. Consequently, the amount of prestroke obtained at the rating number of revolutions $N_R$ is only Pn.

Figure 9:
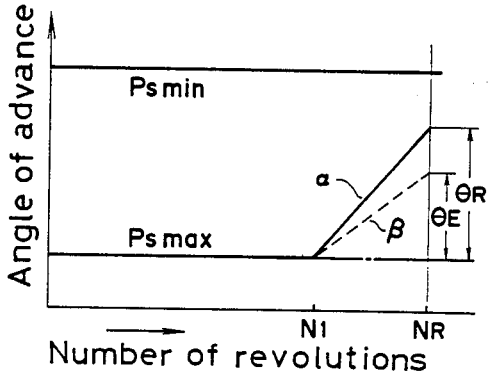
FIG. 9 is a diagram showing the required angle of advance relative to the number of revolutions.

On the other hand, a reduction in the amount of prestroke Ps leads to an increase in the angle of advance of fuel injection. Consequently, the relationship between the number of revolutions N and the angle of advance based on the top dead point is illustrated in FIG. 9 wherein the prestroke Ps is used as a parameter. In other words, in the prestroke limited to Psmax, the angle of advance is shown from the number of revolutions $N_1$ by a solid line $\alpha$ in FIG. 9, when the prestroke is reduced in order to ensure that the pressure prevailing the fuel-pressurizing chamber 7 is within the allowable pressure L, and $_R$ is obtained at the rating number of revolutions $N_R$. On the other hand, the required timing of injection for an engine, i.e., the required angle of advance is shown by a broken line $\beta$, and $\theta_E$ is obtained at the rating number of revolutions $N_R$.

According to the first embodiment of the present invention, however, the cam 10 is rotatingly driven through the angle-of-lag timer 200, so that an angle corresponding to a difference between the aforesaid solid line $\alpha$ and broken line $\beta$ is the angle of lag at the number of revolutions of the cam shaft exceeding $N_1$, and an angle of lag corresponding to $(\theta_R-\theta_E)$ occurs at the rating number of revolutions N.

As a result, even when the prestroke is adjusted to limit the pressure in the fuel-pressurizing chamber 7 to the allowable pressure L or lower, the angle of advance is regulated to the required amount of angle of advance for an engine such that there is no possibility that the range in which the fuel injection pump 100 can be used may become narrower.

Figure 10:
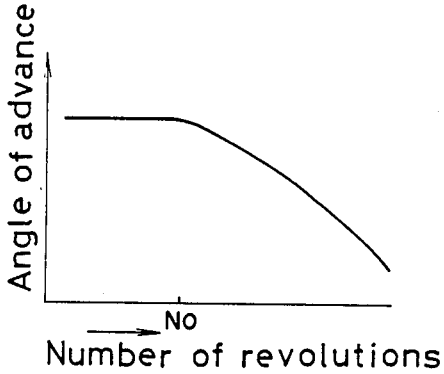
FIG. 10 is a diagram showing the characteristics of an angle-of-advance timer relative to the number of revolutions.

It is to be understood that the angle-of-lag timer 200 includes a housing and a driving shaft having an eccentric cam assembly. The output shaft of an engine is joined to the aforesaid housing, and the cam shaft 9 of the fuel injection pump is connected to the aforesaid driving shaft to couple that output shaft to that cam shaft 9 for rotation. The aforesaid eccentric cam assembly is driven by making use of changes in a pair of weights which are forced away from each other against the action of a spring by centrifugal force in response to changes in the rotational speed of the output shaft of an engine, thereby controlling the revolution phase of the output shaft and cam shaft 9. Such a shaft-controlling device for fuel injection is disclosed in Japanese Utility Model Kokai-Publication No. 57(1982)-150234, and may be used for the purpose as described just above. In this case, the angle-of-lag characteristics as shown in FIG. 10 are obtainable by fixing the direction of rotation of the aforesaid housing to a desired one, so that it is possible to attain an angle of lag from the number of revolutions $N_0$ of the output shaft of an engine (revolving at a speed two times as large as that of the cam shaft 9). Given $N_0/2=N_1$ (in the case of a four-cylinder engine), it is possible to attain the predetermined angle of lag.

With a device for regulating the timing of fuel injection wherein, as disclosed in Japanese Utility Model Kokai-Publication No. 57(1982)-157738, the aforesaid pair of weights are designed to be hydraulically spaced away from each other, it is also possible to regulate the angle of lag as shown in FIG. 9 by the broken line $\beta$ by determining the hydraulic pressure in correspondence to the prestroke and the number of revolutions of the cam shaft 9 exceeding the number of revolutions $N_1$.

Figure 11:
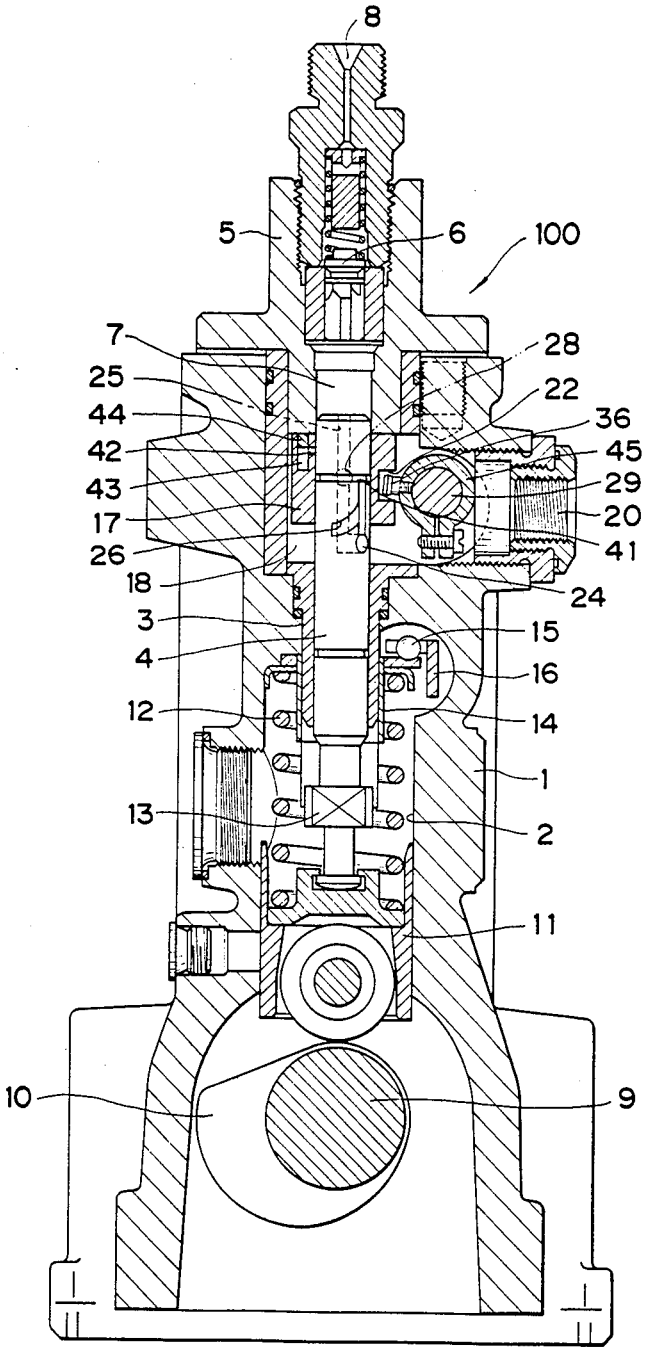
FIG. 11 is a sectional view showing a second embodiment of the fuel injection pump according to the present invention.
Figure 12:
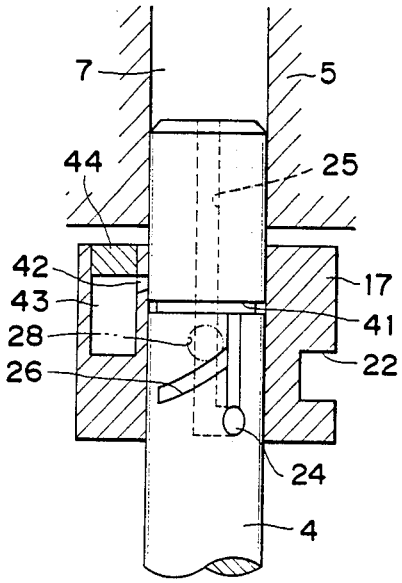
FIGS. 12 and 13 are sectional views illustrating part of the second embodiment operating in various states.
Figure 13:
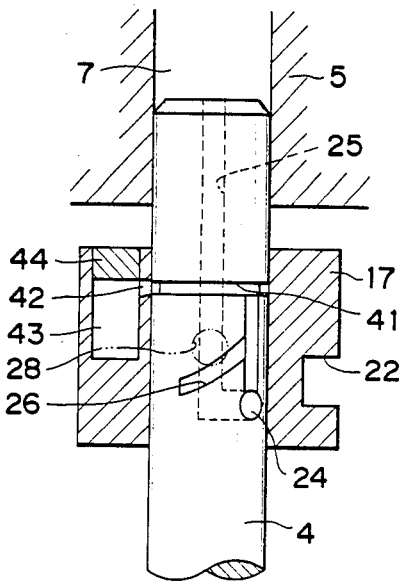

FIGS. 11 to 13 show a second embodiment of the present invention, wherein the fuel injection pump 100 includes therein means for controlling the pressure of injection. This embodiment is different from the first one with respect to the structures of the plunger 4, control sleeve 17 and control rod 29.

The plunger 4 is provided on the outer surface with an annular communication groove 41, to which the upper end of the aforesaid control inclined groove 26 is connected. Above the communication groove 41, a connection port 42 is formed on the inner surface of the aforesaid control sleeve 17. When the effective stroke of plunger 4 does not reach the predetermined value, the connection port 42 is not superposed upon the communication groove 41 prior to the end of injection, as illustrated in FIG. 12. As shown in FIG. 13, however, that port is superposed upon the communication groove 41 prior to the end of injection, only when the fixed effective stroke of plunger 4 reaches the predetermined value. It is noted that the communication groove 41 in the plunger 4 may be dispensed with, and similar results are obtained by forming the connection port 42 in the control sleeve 17 into an annular shape.

The control sleeve 17 is provided with pressure escape or release means which, in this embodiment, is defined by a space 43 formed in the control sleeve 17. More specifically, the space 43 is formed by forming a hole in the control sleeve 17 and closing the upper portion thereof with a plug 44, and is connected with the connection port 42.

The control rod 29 is fixedly provided with a ring 45 which includes an engaging portion 36 which, in turn, engages within an associated groove 22 in the control sleeve 17.

It is to be understood that parts similar to those used in the first embodiment are indicated in the drawings by similar reference numerals, and their explanation is thus omitted for simplification.

Referring to such a fuel injection pump 100, the amount, timing and rate of fuel to be injected are controlled in association with the number of revolutions of and a load on, an engine, for instance. In a low-revolving region, it is generally required that the amount and timing of fuel to be injected by reduced and delayed. Consequently, with a driving device (not shown) driven in response to a control output signal (again not shown), the plunger 4 is rotated in the right direction by the rod 16 and the rotating sleeve 14, and the control sleeve 17 is moved upwardly through the control rod 29, whereby the effective stroke is regulated to a lower value, while the prestroke is adjusted to a higher value. In this case, when the prestroke is adjusted to a higher value, a range over which the slope of the cam diagram is sharp defines the effective stroke. During that effective stroke, the plunger 4 ascends at a high speed, so that the rate of fuel to be injected increases, as already mentioned.

Figure 15:
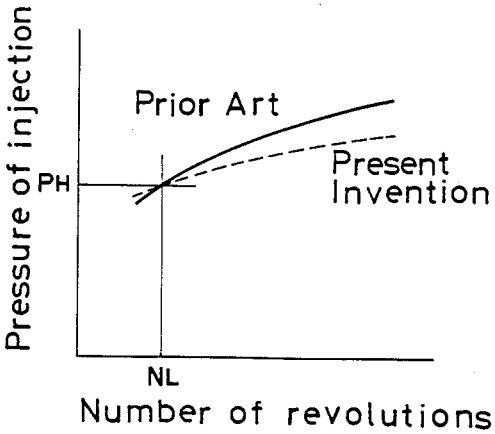
FIG. 15 is a diagram showing the pressure of injection relative to the number of revolutions in the third embodiment.
Figure 16:
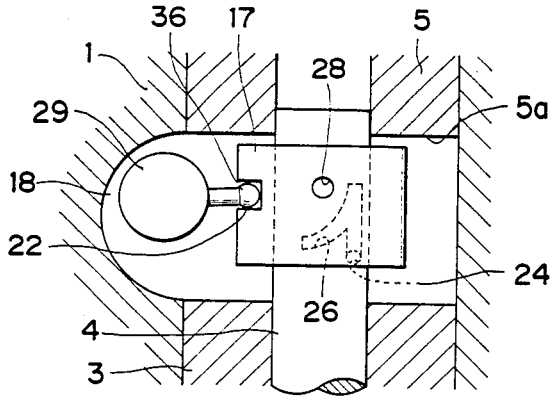
FIG. 16 PRIOR ART
FIGS. 16 to 18 are sectional views of a prior art fuel injection pump operating in various states.
Figure 17:
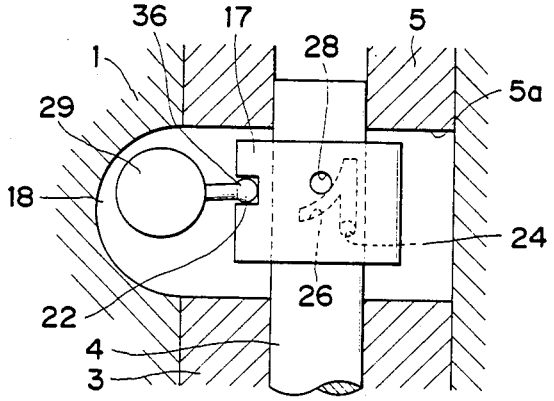
FIG. 17 PRIOR ART
Figure 18:
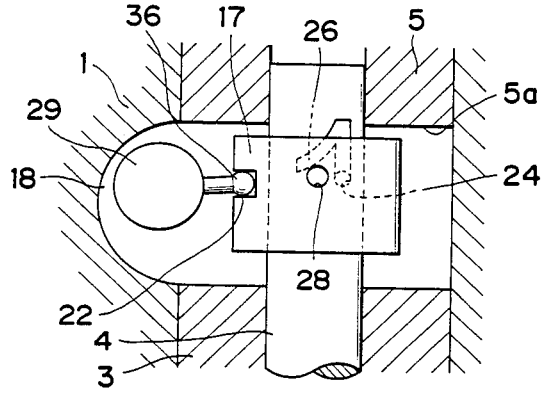
FIG. 18 PRIOR ART

Since the effective stroke is small at the end of injection as illustrated in FIG. 12, the superposition of the control inclined groove 26 upon the cut-off hole 28 takes place prior to the superposition of the communication groove 41 in the plunger 4 upon the connection port 42 in the control sleeve 17. The fuel-pressurizing chamber 7 is then closed over a period of time during the effective stroke, so that the pressure of injection is maintained at a higher value (as expressed in terms of $P_H$ in FIG. 15, for instance).

In a high-revolving region, on the contrary, it is required that the amount and timing of fuel to be injected be increased and advanced. Consequently, the plunger 4 is rotated in the lefthand direction and the control sleeve 17 is moved downwardly to adjust the effective stroke to a higher value and regulate the prestroke to a lower value. In this case, when the prestroke is regulated to a lower value, the effective stroke is defined by a range over which the slope of the cam diagram is gentle. In that effective stroke, the plunger 4 ascends at a lower speed, so that the rate of fuel to be injected is regulated to a lower value, as is the case with the foregoing first embodiment. In some cases, however, with only a reduction in the rate of injection it may not be possible to cope with an increase in the pressure of injection exerted by the plunger which now reciprocates at a high speed.

In such a high-revolving region, however, the effective stroke is increased so that the communication groove 41 in the plunger 4 is superposed upon the connection port 42 in the control sleeve 17 prior to the end of injection, as illustrated in FIG. 13. During that effective stroke, the fuel-pressurizing chamber 4 is thus in communication with the space 43 by way of the communication hole 25, hole 24 through which fuel is sucked and discharged, communication groove 41 and connection port 42, whereby the volume of fuel to be confined in the chamber 7 is increased, so that the pressure of fuel prevailing in the chamber 7 escapes into the space 42 and is decreased. As a result, a limitation is imposed upon the maximum pressure of injection, thus resulting in the pressure of injection being limited to the predetermined value or one that is lower.

Figure 14:
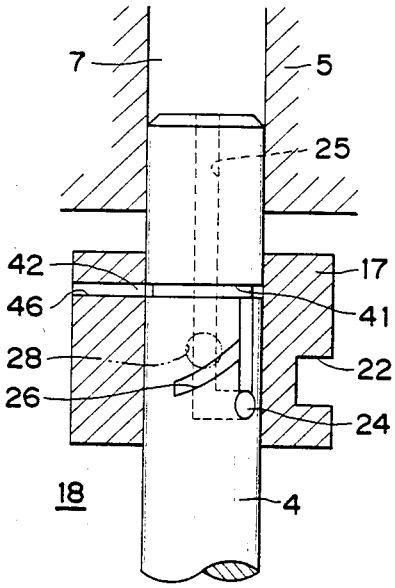
FIG. 14 is a sectional view showing part of a third embodiment of the fuel injection pump according to the present invention.

FIG. 14 illustrates a third embodiment of the present invention. In this embodiment, a leak passage 46 is formed in the control sleeve 17 in the radial direction instead of the space 43 in the second embodiment. The leak passage 46 is connected at one end to the aforesaid connection port 41, and is open at the other end to the foregoing reservoir chamber 18. An amount of fuel contained in the fuel-pressurizing chamber 7 leaks through the passage 46 into the chamber 18, thus defining pressure escape or release means for venting pressure out of the fuel-pressurizing chamber 7. It is to be understood that other parts or structures similar to those of the second embodiment are indicated in FIG. 14 by like reference numerals, and their explanation is omitted for simplification.

Obviously, many modifications and variations of the present invention are possible in the light of the above teachings. It is therefore to be understood that within the scope of the appended claims, the invention may be practiced otherwise than as specifically described.

What is claimed is:

1. A fuel injection pump comprising:

a reciprocating plunger for injecting fuel from a fuel reservoir into a fuel injection chamber, said plunger having a fuel passage means extending therein including one end thereof open to the fuel injection chamber and another end disposed in the fuel reservoir;

a control sleeve extending around said plunger and in which said plunger is slidably mounted, said control sleeve having a cut-off hole extending between the plunger and the fuel reservoir, said plunger sliding over a distance in a first direction within said control sleeve from a first position at which said another end of the fuel passage means is open to the fuel reservoir to a second position at which said another end of the fuel passage means is closed by the control sleeve so that said plunger initiates the injection of fuel into the fuel injection chamber, said distance representing a prestroke of injection, said plunger sliding in said first direction within said control sleeve from said second position to a third position at which said fuel passage means is open to the cut-off port to place the fuel injection chamber in communication with the fuel reservoir and terminate fuel injection into the fuel injection chamber, said control sleeve also having a fuel discharge groove extending along the upper end thereof for discharging fuel from the fuel injection chamber through the fuel passage means when said plunger slides in said first direction past said third position for preventing an increase in fuel pressure within the fuel injection chamber after the fuel injection is terminated; and means for varying the axial position of said plunger relative to said control sleeve to adjust the prestroke.

2. The fuel injection pump as claimed in claim 1, wherein said discharge groove extends along the upper end of said control sleeve in a radial direction with respect to the control sleeve.

3. The fuel injection pump as claimed in claim 1, wherein said upper end of said control sleeve has a trapezoidal cross-sectional shape.

4. The fuel injection pump as claimed in claim 1, and further comprising a valve housing in which the fuel injection chamber is defined; and wherein said means for varying the axial position of said plunger relative to said control sleeve comprises means for moving said control sleeve to a plurality of axial positions relative to the plunger including a position at which said upper end of the control sleeve abuts against said valve housing.

5. A fuel injection pump comprising:

a reciprocating plunger for injecting a fuel from a fuel reservoir into a fuel injection chamber, said plunger having a fuel passage means extending therein including one end thereof open to the fuel injection chamber and another end disposed in the fuel reservoir;

a control sleeve extending around said plunger and in which said plunger is slidably mounted, said control sleeve having a cut-off hole extending between the plunger and the fuel reservoir, said plunger sliding over a first distance in a first direction within said control sleeve from a first position at which said another end of the fuel passage means is open to the fuel reservoir to a second position at which said another end of the fuel passage means is closed by the control sleeve so that said plunger initiates the injection of fuel into the fuel injection chamber, said first distance representing a prestroke of injection, said plunger sliding over a second distance in said first direction within said control sleeve from said second position to a third position at which said fuel passage means is open to the cut-off hole to place the fuel injection chamber in communication with the fuel reservoir chamber and terminate the injection of fuel into the fuel injection chamber, said second distance representing an effective stroke of injection;

adjusting means for adjusting the radial position of said control sleeve relative to said plunger to vary said effective stroke from a predetermined value; and said control sleeve also having a connection port open to the inner surface thereof for discharging fuel from the fuel injection chamber therethrough prior to the termination of fuel injection when the effective stroke is varied by said adjusting means to be higher than said predetermined value.

6. The fuel injection pump as claimed in claim 5, wherein said control sleeve further comprises an enclosed space extending therein open to said connection port and into which the fuel discharged through the connection port passes.

7. A fuel injection pump as claimed in claim 5, and further comprising a fuel reservoir chamber extending around said control sleeve, and a leak passage extending between and open to said connection port and said fuel reservoir chamber and through which the fuel discharged from the connection port passes.

8. A fuel injection pump as claimed in claim 6, and further comprising a plug fixedly secured to said control sleeve for enclosing the space extending within the control sleeve and for maintaining the space enclosed when fuel passes therein.

* * * * *